United States Patent [19]

Trusty

[11] 4,266,216

[45] May 5, 1981

[54] COMBINATION PORTABLE INTRUSION ALARM AND FLASHLIGHT

[76] Inventor: Von A. Trusty, 4703 First St., West, Apt. 195, Bradenton, Fla. 33507

[21] Appl. No.: 11,233

[22] Filed: Feb. 12, 1979

[51] Int. Cl.[3] ..... G08B 13/08

[52] U.S. Cl. ..... 340/546; 200/61.62; 200/61.93

[58] Field of Search ..... 340/546, 545, 691; 200/1 A, 16 B, 159 A, 61.62, 61.93

[56] References Cited

U.S. PATENT DOCUMENTS

| | | | |
|---|---|---|---|
| 761,572 | 5/1904 | Barger . | |
| 793,775 | 7/1904 | Esser . | |
| 1,115,738 | 11/1914 | Randenburg . | |
| 1,679,846 | 8/1928 | Warner . | |
| 2,259,696 | 10/1941 | Hulst | 340/546 |
| 2,277,902 | 3/1942 | Carbonard | 200/16 B |
| 2,780,689 | 2/1957 | Cavera . | |
| 2,826,656 | 3/1958 | Gordon . | |
| 3,175,066 | 3/1965 | Fiddler . | |
| 3,383,674 | 5/1968 | Soltall et al. . | |
| 3,641,571 | 2/1972 | Kitman . | |
| 3,696,380 | 10/1972 | Murphy | 340/546 |
| 3,797,005 | 3/1974 | Schwarz | 340/545 |
| 3,797,006 | 3/1974 | Reininger . | |
| 3,887,909 | 6/1975 | Beiswenger et al. . | |
| 3,938,120 | 2/1976 | O'Connell . | |
| 3,950,746 | 4/1976 | Davies . | |
| 3,968,484 | 7/1976 | Weber . | |
| 3,971,009 | 7/1976 | Fujiwara . | |
| 4,012,731 | 3/1977 | Solomon . | |
| 4,032,731 | 6/1977 | Bryceland . | |
| 4,059,832 | 11/1977 | Conklin . | |
| 4,139,845 | 2/1979 | Wasburn | 340/546 |

*Primary Examiner*—Glen R. Swann, III
*Attorney, Agent, or Firm*—Dybvig & Dybvig

[57] ABSTRACT

A portable alarm device adapted to be actuated upon the movement of a door, a window, or other movable object. The alarm device includes a slidably supported actuating rod adapted to be engaged or moved by the movable object and that electrically closes a switch in order to energize both a light assembly and a bell assembly in the alarm device. A manual switch permits the light assembly to be operated independently of any movement of the rod so that the alarm device may be used as a portable flashlight or lantern.

2 Claims, 6 Drawing Figures

FIG-1
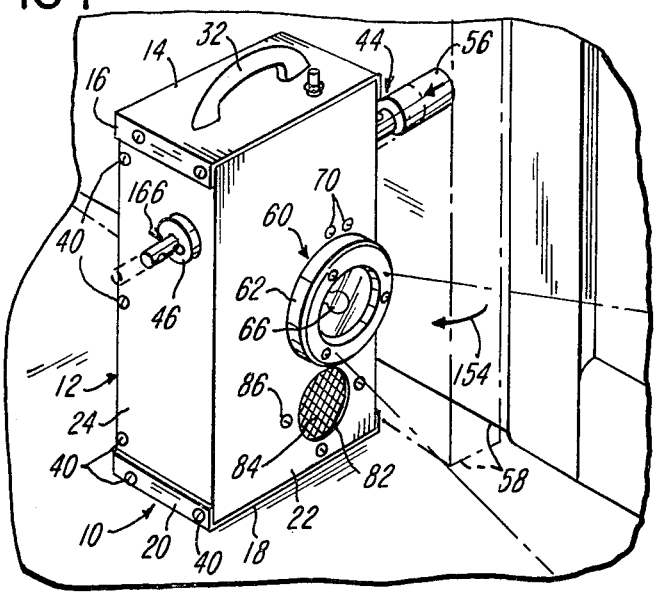
FIG-3
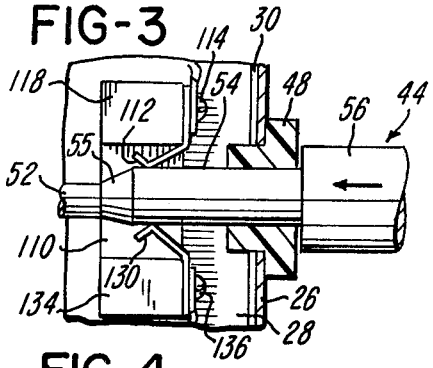
FIG-4
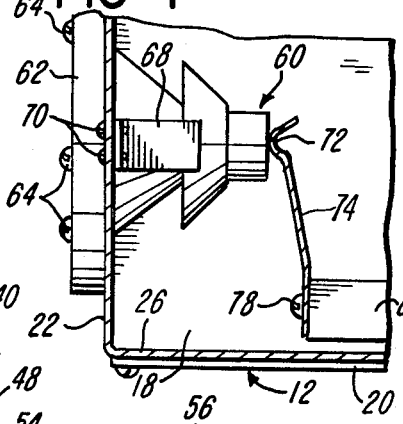
FIG-2
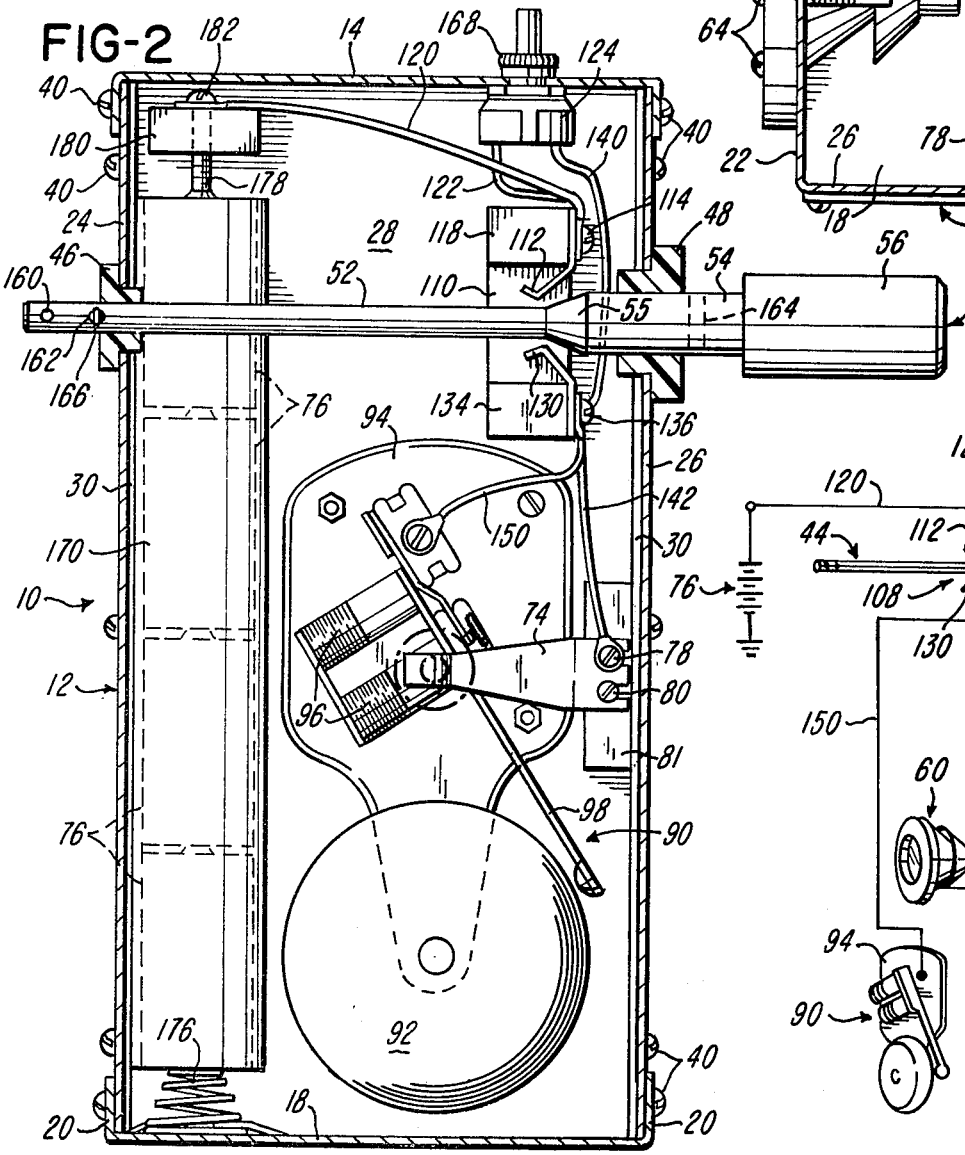
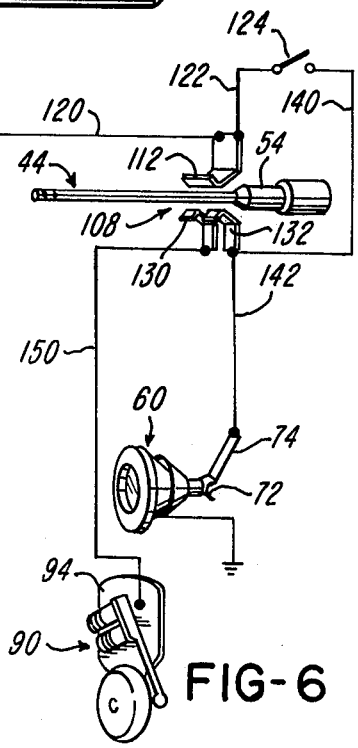
FIG-6

COMBINATION PORTABLE INTRUSION ALARM AND FLASHLIGHT

BACKGROUND OF THE INVENTION

The present invention relates to alarm devices, and more particularly, to an alarm device that is actuated upon the opening of a door, a window, or other movable object.

Portable alarm devices that use batteries and that can be carried with a person and set beside a window, a door, or other movable object, to indicate movement of the door or window, are known in the art. Although usable in the home, such devices are particularly useful for travelers, such as those staying in motel or hotel rooms and wanting protection against unauthorized entry.

A common disadvantage or prior devices is that they are complicated in design and relatively expensive to manufacture. One having only an occasional need for a portable alarm device, such as a person who wants to use such a device during infrequent travel, is often unwilling to pay the cost for such a device.

SUMMARY OF THE INVENTION

This invention provides an inexpensive, portable alarm device that also functions as a flashlight or lantern. Accordingly, the infrequent traveler that might forego the advantages of portable alarms because of their cost and limited use will be more likely to utilize the device of this invention.

In accordance with the present invention, there is provided a portable alarm device having light emitting means, an actuating member adapted to be moved upon the opening of a door, window, or other movable object, and first switch means for connecting the light emitting means to a power source within the alarm device in response to the movement of the actuating member. The device further includes second switch means for permitting manual connection of the light emitting means to the power source independently of the actuating member and the first switch means.

In the illustrated embodiment, the alarm device includes a housing and sound emitting means within the housing connected, along with the light emitting means, to the power source by the first switch means. The actuating member comprises a rod supported for sliding movement through the housing and includes a conductive, contact engaging, section for connecting or closing electrical contacts of the first switch means.

It is therefore an object of the present invention to provide an improved alarm device.

It is a further object of the present invention to provide an alarm device that is relatively inexpensive to manufacture.

It is still a further object of the present invention to provide a portable alarm device that may be easily carried and is simple in operation.

It is still a further object of the present invention to provide a portable alarm device emitting both sound and light when actuated, and that may also be used as a portable flashlight or lantern.

These and other objects of the invention will become more apparent from the following description and the drawings.

BRIEF DESCRIPTION OF THE DRAWINGS

FIG. 1 is a perspective view of an alarm device made in accordance with the present invention and positioned to be actuated by the opening of a door.

FIG. 2 is a transverse sectional view of the alarm device of FIG. 1, showing the actuating rod in one position.

FIG. 3 is a fragmentary sectional view showing the actuating rod in a second position wherein it will actuate the alarm device.

FIG. 4 is a fragmentary sectional view showing a light assembly incorporated within the alarm device.

FIG. 6 is a schematic view of the circuitry within the alarm device.

DESCRIPTION OF THE PREFERRED EMBODIMENT

Figure 5:
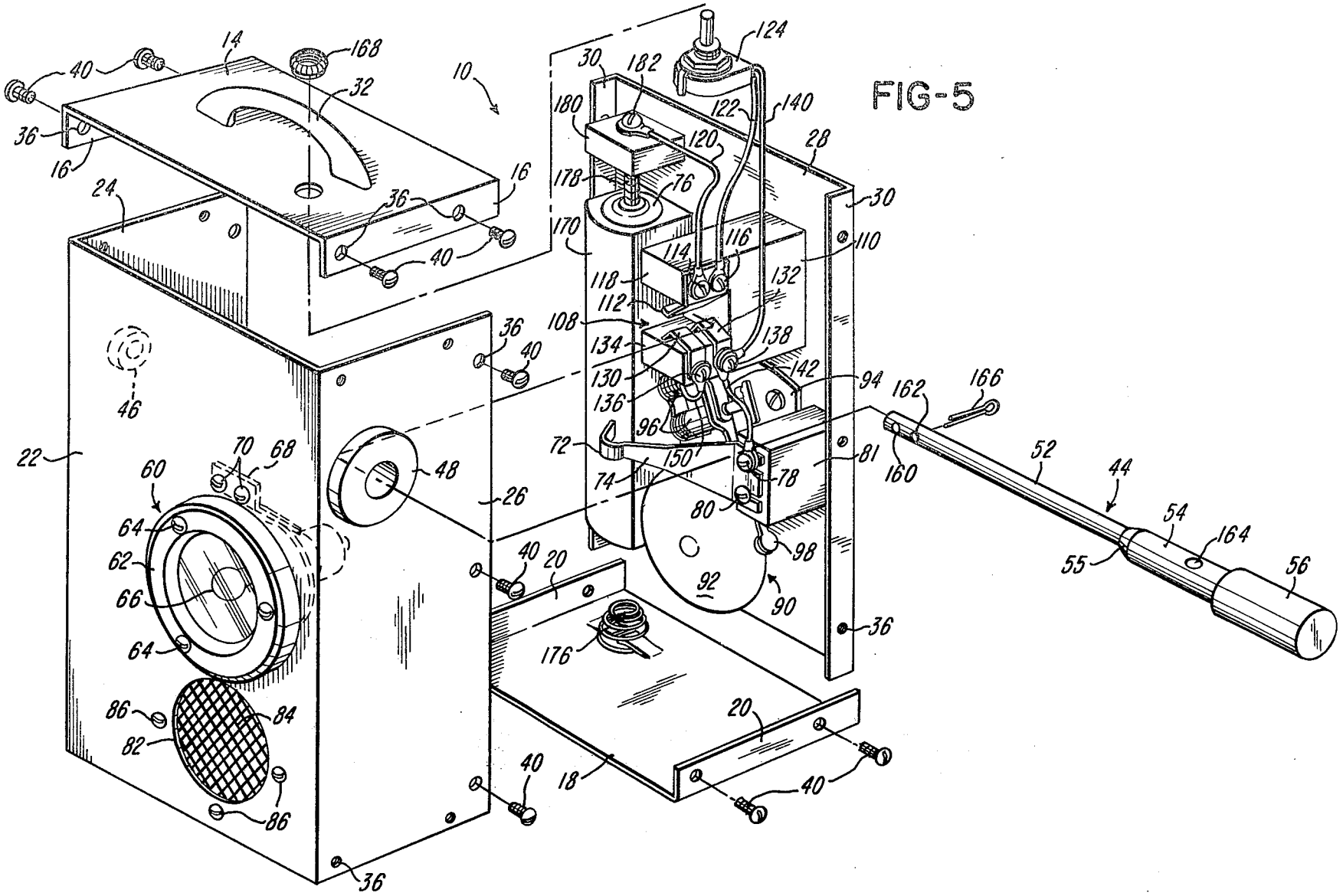
FIG. 5 is an exploded perspective view of the alarm device.

Referring now to FIGS. 1 and 5, there is shown an alarm device 10 in accordance with the present invention that includes a housing 12. The housing 12 includes a top wall 14 having depending flanges 16, a bottom wall 18 having upstanding flanges 20, a front wall 22, opposing side walls 24 and 26 extending from and formed integrally with the front wall 22, and a back wall 28 having side flanges 30. A handle 32 is secured to the housing top wall 14.

When the housing 12 is assembled, the flanges 16 and 20 overlap the upper and lower edges of the side walls 24 and 26, and the side walls 24 and 26 overlap the flanges 30. The overlapping walls and flanges of the housing have holes 36 for receiving screws 40 so that the top, bottom, side and back walls may be secured together as shown in FIG. 1.

As seen best in FIG. 2, an alarm actuating member or rod 44 projects outwardly of each of the side walls 24 and 26 and is supported for sliding movement through the side walls 24 and 26 by a bearing 46 mounted through an opening in the side wall 24 and a bearing 48 mounted through an opening in the side wall 26. The bearing 46 generally supports a smaller diameter section 52 of the rod 44 while the bearing 48 supports a larger diameter section 54 of the rod. A sloping rod section 55 interconnects the smaller and larger diameter sections thereof. The end of the rod 44 near larger section 54 has an enlarged cylindrical portion 56 that projects entirely outside the housing 12. As shown in FIG. 1, the alarm device 10 may be positioned adjacent a door 58. When the door is opened, it will push the enlarged rod end portion 56 toward the housing 12, causing the rod 44 to slide a short distance through the bearings 46 and 48 and, in a manner to be described below, thereby actuate the alarm device 10.

A light assembly 60 is mounted through an opening in the front wall 22 and includes a support ring 62 secured to the front wall 22 by screws 64. The light assembly may have a conventional design, such as that found in battery operated flashlights, and includes a lamp 66. Although not shown in detail, one terminal of the lamp 66 is preferably grounded to the housing 12, which is therefore preferably made from a conductive metal, by a spring metal contact plate 68. The contact plate 68 is secured to the housing front wall 22 by a pair of screws 70. Alternatively, the housing 12 could be made from plastic and a wire (not shown) could connect the terminal of the lamp to other suitable grounding means. As seen best in FIG. 4, the other terminal of the lamp 66 engages a curved end 72 of a spring metal contact arm 74 which is connected, in a manner to be described later, to a set of batteries 76 within the housing 12 when the alarm device 10 is actuated. Contact arm 74 is mounted by a pair of screws 78 and 80 to a support member 81, which in turn is secured to the housing back wall 28.

An alarm bell assembly 90 (seen best in FIG. 2) is positioned in the housing 12. The bell assembly 90 includes a bell 92 supported on a plate 94 that is secured to the back wall 28. The bell assembly 90 further includes a pair of solenoids 96 which, when electrically energized, cause a striker arm 98 to oscillate and strike the bell 92. The illustrated bell assembly 90 is a conventional D.C. operated door bell. However, it should be appreciated that any other type of device for emitting an audible alarm, such as a buzzer, could likewise be used.

To maximize the sound emitted by the alarm device 10, the front wall 22 of the housing includes an opening 82 covered with a wire mesh screening material 84 through which sound created by the bell assembly 90 is emitted. The screening material 84 is secured to the housing front wall 22 by screws 86.

The circuitry for electrically connecting the light assembly 60 and the bell assembly 90 to the batteries 76 includes a switch assembly 108 mounted on a generally U-shaped support member 110 secured to the back wall 28. The switch assembly 108 includes a first spring contact 112 mounted by a pair of screws 114 and 116 to one leg 118 of the support member 110. A wire 120 leading to the batteries 76 is connected to the contact 112 by the screw 114. A wire 122 leading to a manually operated switch 124, described below, is connected to the contact 112 by the screw 116 (see FIG. 5).

The switch assembly 108 further includes a second spring contact 130 and a third spring contact 132. The second and third contacts 130 and 132 are mounted side-by-side on the other leg 134 of the support member 110 by screws 136 and 138, respectively. Contacts 130 and 132 are spaced apart but both generally confront the first contact 112. A wire 140, also leading to the manual switch 124, is connected by the screw 138 to the contact 132, and a wire 142 leading to the screw 78 and the contact arm 74 is connected by the screw 138 to the contact 130. A wire 150, leading to the bell assembly 90, is connected by the screw 136 to the contact 130.

The electrical circuitry within the alarm device 10, including the batteries 76, switch assembly 108, light assembly 60 and bell assembly 90, is illustrated schematically in FIG. 6.

The contact 112 and the contacts 130 and 132 are adapted to be closed, i.e. electrically interconnected, by the larger diameter portions of the sloping section 55 and the larger diameter section 54 of the actuating rod 44 when the rod 44 is moved from a first position (shown in FIG. 2) to a second position (shown in FIG. 3). Accordingly, the smaller diameter section 52 of the rod 44 is sized so that it will not bridge the contacts 112, 130 and 132, while the larger diameter section 54 and the larger portions of the sloping section 55 have diameters sufficiently large to bridge the contacts.

In operation, when the door 58 is opened in the direction indicated by arrow 154 in FIG. 1, the enlarged end portion 56 of the actuating rod 44 is engaged and is pushed toward the housing 12 by the door from its position shown in FIG. 2 into the position illustrated in FIG. 3. In such position, the larger diameter section 54 of the rod 44 engages and electrically interconnects contacts 112, 130 and 132. The contact 112 and the contacts 130 and 132 connect the batteries 76 to the bell assembly 90 by way of the wires 120 and 150, and simultaneously connect the batteries to the light assembly 60 by way of the wires 120 and 142 and the contact arm 74. Accordingly, the area in the vicinity of the device 10 is bathed with light and, simultaneously, the alarm bell is energized. The combination of both visual and audible alarms not only will serve well to inform of an unauthorized opening or a door or the like by an intruder, it also will provide an abrupt, intimidating notice to the intruder that his actions are being signaled.

In the preferred embodiment, the rod 44 is made of a conductive metal to provide electrical connection between the contacts of the switch assembly 108. The bearings 46 and 48 are made of an insulating material, such as nylon or other plastic, in order to electrically isolate the rod from the housing 12. Alternatively, only that section of the rod 44 adapted to be engaged with the contacts 112, 130 and 132 need be made of a conductive metal. Thus, the part thereof adapted to engage the contacts could comprise a solid metal section or else a metal sheath, the rod 44 otherwise being made entirely of nylon or other suitable plastic. The alarm device 10 is so constructed that, after it is energized, it may be deenergized by returning the actuating rod 44 to its position shown in FIG. 2. When the rod 44 is returned to its position shown in FIG. 2, the device is capable of repeating its operation. No further resetting is required.

The rod 44 has three holes or bores 160, 162 and 164, each of which passes through the rod and is generally perpendicular to its longitudinal axis. The holes 160 and 162 are located at the free end of the smaller diameter section 52 and the hole 164 is located along the larger diameter, contact engaging section 54. It should be noted that the rod 44 is sufficiently long that all of the holes 160, 162 and 164 may be located outside the housing 12 at the same time. The holes 162 and 164 are sized to receive cotter pins, such as the cotter pin 166 shown in hole 162 in FIGS. 1, 2 and 5. Holes 162 and 164 are intended to be used for limiting the movement of the rod 44. Thus, the illustrated cotter pin 166 in hole 162 prevents the rod 44 from being pulled so far to the right (as viewed in FIG. 2) that the rod will fall out of the smaller bearing 46. In addition, a cotter pin (not shown) in hole 164 would limit the leftward movement (as viewed in FIG. 2) of the rod. Cotter pins in both holes 162 and 164 would limit movement of the rod in both directions so that it would essentially be locked in the position of FIG. 2 and thus incapable of energizing the light and bell assemblies.

One end of a string or other piece (not shown) can be tied to a door or a window and its other end passed through the hole 160 and tied to the rod 44. Upon movement of such door or window away from the alarm device 10, the rod 44 will be pulled toward the left from its position shown in FIG. 2 to its position shown in FIG. 3, thereby actuating the alarm device 10. Because the rod 44 can be either pushed or pulled to actuate the visible and audible alarms, it can readily be seen that the alarm device 10 is usable with both inwardly and outwardly opening doors and with windows which may be opened upwardly, downwardly, inwardly or outwardly.

The aforementioned manual switch 124 is secured to the housing top wall 14 by a nut 168. It permits the light assembly 60 to be operated independently of the rod 44 without simultaneously operating the bell assembly 90. By manually closing the switch 124, the batteries 76 are connected to the light assembly 60 by way of wires 120, 122, 140 and 142, thus bypassing the switch assembly 108.

As seen best in FIGS. 2 and 5, the batteries 76 may be held within a receptacle 170 inside the housing 12 between a spring contact 176 secured to the bottom wall of the housing and an elongated screw contact 178. The contact 178 is threadedly mounted on a support member 180, which in turn is secured to the housing back wall 28. One end of the previously mentioned wire 120 is clamped between the support member 180 and the head 182 of the screw contact 178.

It should be apparent from the above that the alarm device 10 can be conveniently carried, for example in a car trunk, and advantageously operated either as an alarm device or as a portable lantern. When operated as an alarm device, movement of the actuating rod 44 will cause the alarm device 10 to emit both visible and audible signals. Only the lamp 66 is energized, under control of the manual switch 124, when the device is operated as a lantern. Preferably, when used as a lantern, cotter pins are inserted into the holes 162 and 164 in order to restrict the movement of the rod 44 and thus prevent operation of the audible alarm.

Although the presently preferred embodiment of the present invention has been described, it should be understood that various changes may be made within the scope of the appended claims.

Having thus described my invention, I claim:

1. A portable alarm device, comprising:

a housing including two opposed side walls;

a power source fixed to said housing;

sound emitting means fixed to said housing;

light emitting means fixed to said housing;

first switch means within said housing for connecting said power source to both said sound and said light emitting means, said first switch means including a first contact connected to said power source, a second contact connected to said light emitting means, and a third contact connected to said sound emitting means;

an actuating rod mounted on said housing for sliding movement along a path extending through the space separating said first contact from said second and said third contacts, said rod including a first section having a size insufficient to bridge said first, second and third contacts and a conductive larger section having a size sufficient to bridge said first, second and third contacts for engaging and electrically connecting said first contact to both said second contact and said third contact to close said first switch means, and said rod having opposite ends projecting outside of said housing beyond both of said side walls and adapted to be moved in response to the movement of a door, window, or other movable object to close said first switch means;

means to restrict sliding movements of said actuating rod so that said opposite ends cannot enter said housing; and manuallly operable second switch means exposed to the exterior of said housing for connecting said power source to said light emitting means independently of said actuating rod.

2. The alarm device of claim 1, wherein said rod includes a pair of spaced apart bores, said bores being so located that they may both be positioned outside said housing adjacent to respective opposite ones of said side walls, each bore extending generally perpendicular to the longitudinal axis of said rod for receiving a pin in order to restrict the sliding movement of said rod.

* * * * *